US006109790A

United States Patent [19]

von Gynz-Rekowski et al.

[11] Patent Number: 6,109,790

[45] Date of Patent: Aug. 29, 2000

[54] LUBRICANT CIRCULATION SYSTEM FOR DOWNHOLE BEARING ASSEMBLY

[75] Inventors: Gunther von Gynz-Rekowski; Tuong T. Le, both of Houston, Tex.

[73] Assignee: Pegasus International, Inc., British West Indies, Cayman Islands

[21] Appl. No.: 09/163,968

[22] Filed: Sep. 30, 1998

[51] Int. Cl.[7] ..... E21B 10/24; F16C 33/10

[52] U.S. Cl. ..... 384/97; 175/107; 384/291; 384/316

[58] Field of Search ..... 384/97, 98, 291, 384/292, 322, 397, 398, 313, 316, 321; 175/107

[56] References Cited

U.S. PATENT DOCUMENTS

| | | | |
|---|---|---|---|
| Re. 30,257 | 4/1980 | Fox | 175/107 |
| 3,722,609 | 3/1973 | Kern et al. | 175/92 |
| 3,730,284 | 5/1973 | Striegler | 175/92 |
| 3,741,321 | 6/1973 | Slover, Jr. et al. | 175/40 |
| 3,863,737 | 2/1975 | Kakihara | 384/97 |
| 4,019,591 | 4/1977 | Fox | 175/107 |
| 4,080,094 | 3/1978 | Jeter | 415/107 |
| 4,114,704 | 9/1978 | Maurer et al. | 175/107 |
| 4,126,406 | 11/1978 | Traylor et al. | 417/373 |
| 4,260,032 | 4/1981 | Fox | 175/107 |
| 4,410,054 | 10/1983 | Nagel et al. | 175/107 |
| 4,427,308 | 1/1984 | Sandberg | 384/115 |
| 4,511,193 | 4/1985 | Geczy | 384/611 |
| 4,548,283 | 10/1985 | Young | 175/107 |
| 4,560,014 | 12/1985 | Geczy | 175/107 |
| 4,576,488 | 3/1986 | Steiner et al. | 384/291 |
| 4,577,704 | 3/1986 | Aumann | 175/107 |
| 4,593,774 | 6/1986 | Lingafelter | 175/107 |
| 5,069,298 | 12/1991 | Titus | 175/107 |
| 5,143,455 | 9/1992 | Squyres | 384/97 |
| 5,195,754 | 3/1993 | Dietle | 175/107 X |
| 5,217,080 | 6/1993 | Wenzel et al. | 175/107 |
| 5,248,204 | 9/1993 | Livingston et al. | 384/97 |
| 5,377,771 | 1/1995 | Wenzel | 175/107 |
| 5,385,407 | 1/1995 | DeLucia | 384/97 |
| 5,713,670 | 2/1998 | Goldowsky | 384/292 X |

*Primary Examiner*—Thomas R. Hannon
*Attorney, Agent, or Firm*—Duane, Morris & Heckscher LLP

[57] ABSTRACT

An improved lubricant cooling system for a sealed bearing section used in drilling with downhole motors comprises a radial bearing or bearings which preferably contain internal and external spiral grooves such that rotation of the central hollow shaft which supports the drillbit forces lubricant up the external grooves toward the upper seal and then back down in the internal grooves along the cooled hollow shaft which has drilling mud flowing through it. Similarly, the rotation of the hollow shaft forces lubricant through an internal spiral in a lower radial bearing or bearings until it reaches the lower seal at which time it is forced into the external spirals past the thrust bearings in the bearing section. This axial circulation effect allows the removal of heat efficiently from the lubricant by virtue of circulating drilling mud in the hollow shaft and in the outer annulus returning to the surface. The bearing section operating life is thus extended many hours because the lubricant attains a more uniform temperature throughout.

21 Claims, 3 Drawing Sheets

LUBRICANT CIRCULATION SYSTEM FOR DOWNHOLE BEARING ASSEMBLY

FIELD OF THE INVENTION

The field of this invention relates to sealed bearing systems used with downhole motors, and more particularly, techniques for prolonging the life of such bearing sections through improved lubricant cooling.

BACKGROUND OF THE INVENTION

In typical assemblies for drilling with downhole motors, a progressing cavity-type motor is used which has a rotor operably connected to a driven hollow shaft which supports the bit at its lower end. The fluid used to operate the motor flows through the hollow shaft and through the bit nozzles and is returned in the annulus formed by the drilling string and the wellbore. A bearing section is formed between an outer housing and the hollow shaft. The bearing section can be built as a sealed bearing section or mud-lubricated bearing section. Sealed bearing sections are used in mud- and air-drilling applications. Mud-lubricated bearing sections are mainly used in mud-drilling applications. Mud-lubricated bearing sections have limited usage in air-drilling applications.

The bearing section typically includes one or more thrust bearings, one or more radial bearings, and upper and lower seals between the outer housing and the rotating hollow shaft. Typically, to compensate for any thermal effects due to the difference between surface temperature and downhole temperatures, as well as to compensate for any entrained compressible gases in the sealed fluid reservoir surrounding the bearings, one of the seals is placed on a floating piston to allow movement to compensate for such thermal and hydrostatic effects. Some designs incorporate floating seals at both upper and lower ends of the lubricant reservoir around the radial and thrust bearings. Typical of some prior art designs involving sealed bearing systems are U.S. Pat. Nos. 4,593,774; 5,069,298; 5,217,080; 5,248,204; 5,377,771; 5,385,407; and RE 30,257.

One of the serious problems in sealed bearing sections as described above is their short life. Sealed bearing section failures can be caused by a variety of reasons, but one of the principal ones is lubrication failure. One of the main reasons for lubrication failure is overheating of the lubricant, particularly in the areas adjacent the upper and lower seals. In prior designs there has been little lubricant movement in the area of the upper and lower seals, which has resulted in undue heating of the lubricant to the point where the lubricant vaporizes and is not present in the vicinity near the end seals. This situation can create metal-on-metal rubbing and the generation of small, metallic contaminants which can engage the seals and cause their failure. Upon loss of either the upper or lower seals, the bearing assembly is no longer serviceable and drilling must stop to remove the assembly from the wellbore for repairs.

While numerous configurations of sealed bearing sections have been tried in the past, none have effectively addressed the need for more efficient lubricant circulation and cooling within the confined space of the downhole bearing section. It is, thus, an objective of the present invention to work within the confines of a typical bearing section and provide a design which will induce lubricant circulation which, in turn, enhances heat transfer from the lubricant to the circulating drilling mud in the hollow shaft and return drilling mud in the annulus. Another objective of the present invention is to incorporate the need to circulate the lubricant into the design of the radial bearing or bearings in the sealed bearing section. Yet another objective is to prolong bearing life from the typical range now experienced of approximately 80 hours of useful life to 500 hours of useful life and beyond. These and other objectives will become apparent to those skilled in the art from a description of the preferred embodiment below.

SUMMARY OF THE INVENTION

An improved lubricant cooling system for a sealed bearing section used in drilling with downhole motors is disclosed. The radial bearing or bearings preferably contain internal and external spiral grooves such that rotation of the central hollow shaft which supports the drillbit forces lubricant up the external grooves toward the upper seal and then back down in the internal grooves along the cooled hollow shaft which has drilling mud flowing through it. Similarly, the rotation of the hollow shaft forces lubricant through an internal spiral in a lower radial bearing or bearings until it reaches the lower seal at which time it is forced into the external spirals past the thrust bearings in the bearing section. This axial circulation effect allows the removal of heat efficiently from the lubricant by virtue of circulating drilling mud in the hollow shaft and in the outer annulus returning to the surface. The bearing section operating life is thus extended many hours because the lubricant attains a more uniform temperature throughout.

DETAILED DESCRIPTION OF THE PREFERRED EMBODIMENT

Figure 1:
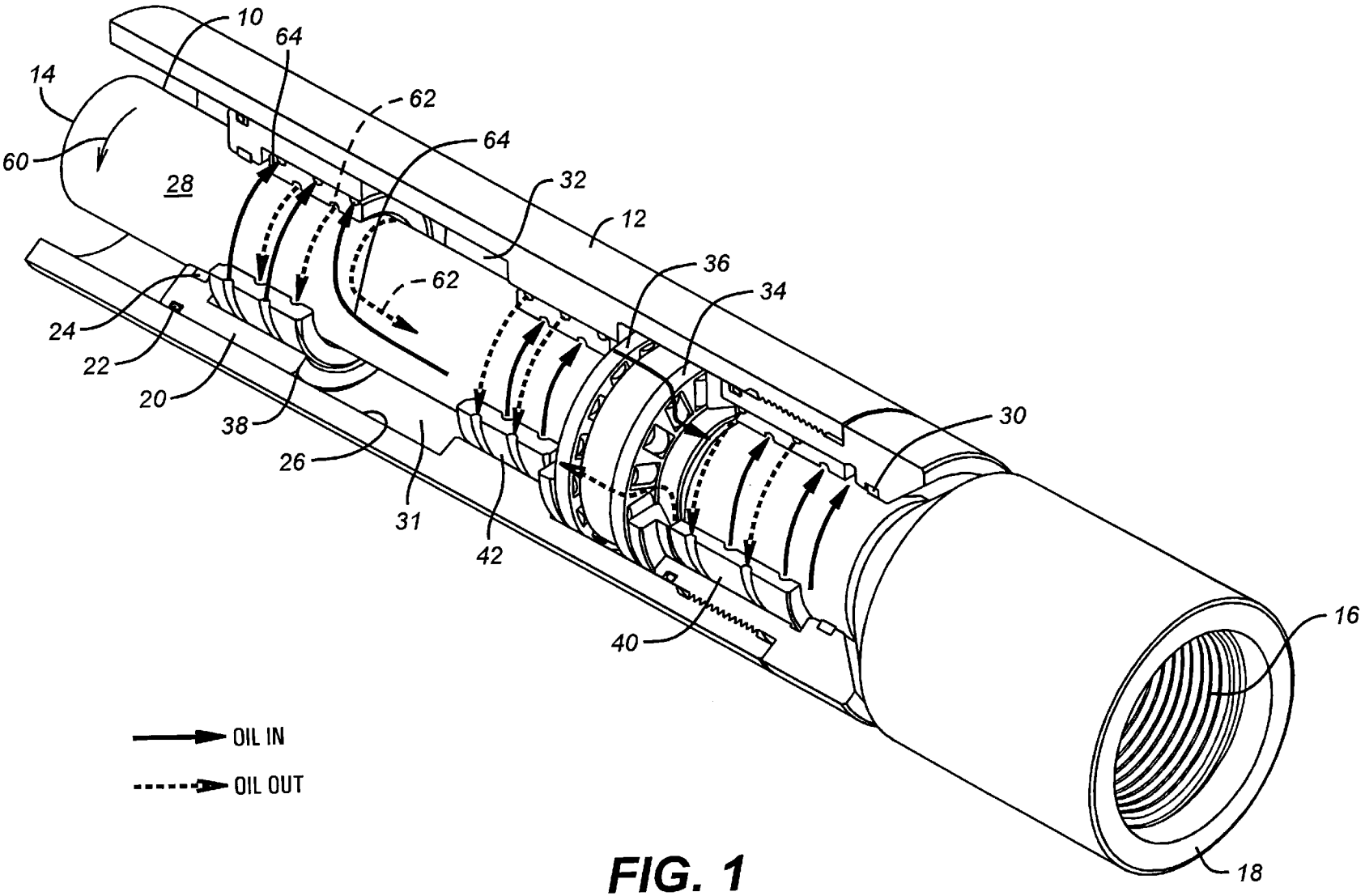
FIG. 1 is a perspective view of the bearing section, showing the flow of lubricant therein.

Referring to FIG. 1, a portion of a bearing section used in conjunction with a downhole motor (not shown) is illustrated. A hollow shaft 10 extends through a housing 12. The upper end 14 is ultimately attached to the rotor of a progressing-cavity-type downhole motor (not shown). A drillbit (not shown) is typically connected at threads 16 at the lower end 18 of the hollow shaft 10. A floating piston 20 contains external seal 22 and internal seal 24. Seal 22 seals against the inner wall 26 of housing 12, while seal 24 seals against the outer surface 28 of shaft 10. Housing 12 also incorporates a lower seal 30 which rides against the surface 28 of shaft 10 to define the lower end of the annular lubricant cavity 32. Between the seals 22 and 24 in the upper end and 30 on the lower end, and within the cavity 32, there are lower and upper thrust bearings 34 and 36, respectively. Axial loads in a direction extending toward upper end 14 are carried by thrust bearing 36, which transmits such loads into the housing 12. Conversely, loads extending in the direction toward lower end 18 are transferred to housing 12 through lower thrust bearing 34.

Also found within cavity 32 is upper radial bearing 38, lower radial bearing 40, and central radial bearing 42. The radial bearings 38, 40, and 42 are preferably contoured as bushings. "Radial bearing" as used herein includes bearings and bushings. Those skilled in the art will appreciate that varying amounts of radial bearings can be used without departing from the spirit of the invention. Upper radial bearing 38 is mounted to floating piston 20 for tandem movement to compensate for thermal and hydrostatic pressure forces generated from the lubricant 31 in cavity 32. This loading occurs because when the lubricant 31 is installed in cavity 32, it is at room temperature, while downhole temperatures can be as high as 400° F. This results in an expansion of the lubricant 31, thus the presence of piston 20 compensates for such thermal loads. Pressure loads can also occur if there is any trapped compressible gas in the cavity 30. When elevated downhole hydrostatic loading acts on such compressible gas, it increases the pressure on the lubricant 31 in cavity 32, thus requiring compensation from piston 20. It should be noted that the cavity 32 is normally filled under a vacuum where it is desirable to remove all compressible gases with the added lubricant 31. However, this procedure is not perfect and there could be situations where some trapped compressible gas exists in cavity 32. Accordingly, piston 20 compensates for forces created as described above. In the preferred embodiment, the radial bearings 40 and 42 are of similar design to that of bearing 38, but they do not necessarily have to be similar, as will be described below.

Figure 2:
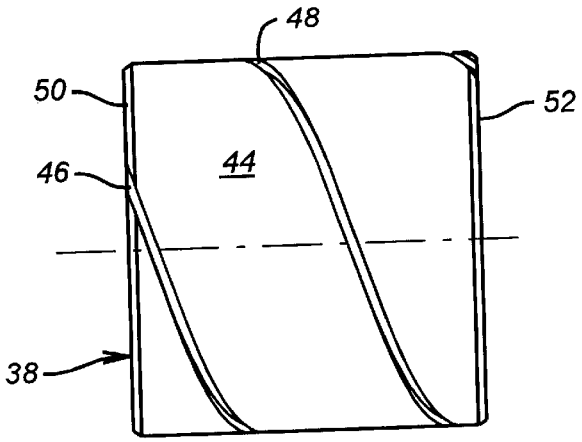
FIGS. 2–4 are, respectively, external, internal, and end views of a radial bearing used in the assembly shown in FIG. 1 which induces lubricant circulation.
Figure 4:
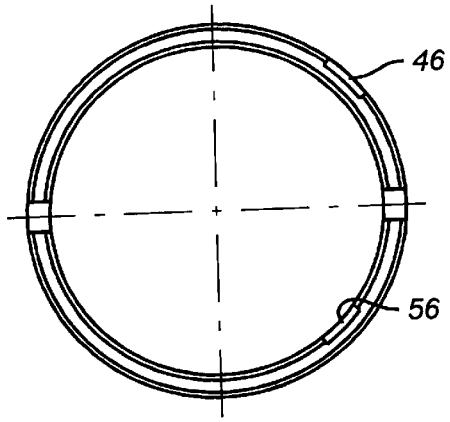
Figure 3:
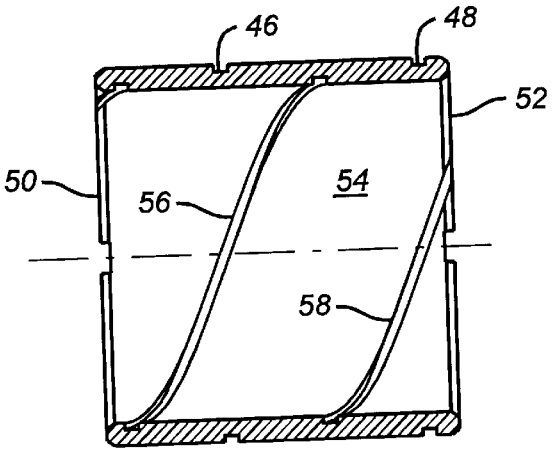

FIGS. 2–4 illustrate the preferred embodiment for one of the radial bearings, such as 38. The radial bearing 38 has an annular shape, as seen in FIG. 4. It has an external surface 44 which has a series of spiral grooves, such as 46 and 48. The grooves extend from top end 50 to bottom end 52. Depending on how many grooves are used, they are staggered in their beginning at top end 50 so that in the preferred embodiment, they are equally spaced circumferentially. FIG. 3 shows the section view of a radial bearing 38 which illustrates its inner surface 54 on which are preferably a multiplicity of parallel spiral grooves 56 and 58. While two grooves 56 and 58 are shown, additional or fewer spiral grooves can be used on both the inside face 54 and the external surface 44. While even spacing of the spiral grooves is preferred, other spacings can be used without departing from the spirit of the invention. While the preferred embodiment is a series of parallel spiral grooves, other configuration of the grooves can be employed and the pitch, if a spiral is used, can be varied, all without departing from the spirit of the invention.

Referring again to FIG. 3, the grooves 56 and 58 are preferably staggered in their beginnings at top end 50 and bottom end 52. Referring to FIG. 4, it can be seen that the grooves that are present on the external surface 44 are staggered with respect to the grooves that are present on the inner surface 54, with the preferred distance being approximately 90°, although other offsets can be used, or even no offset, without departing from the spirit of the invention. Those skilled in the art will appreciate that the overall length between the upper end 50 and lower end 52 can be varied to suit the particular application. The number of radial bearings, such as 38, 40, and 42, can be varied in the cavity 32 to suit the particular application.

It should be noted that the orientation of the spiral grooves, such as 46, 48, 56 and 58, is that they spiral downwardly and in a clockwise direction as they extend from the upper end 50 to the lower end 52. Reverse orientations are also within the spirit of the invention. In the preferred embodiment, the spirals of grooves 46 and 48 are parallel to the spirals 56 and 58. This arrangement accounts for why shaft 10, rotating right-hand in the direction of arrow 60, forces lubricant 31 down toward radial bearings 38, 40, and 42 on the internal grooves 56 and 58, while at the same time forcing lubricant 31 up on the external grooves 46 and 48. The groove orientation, as among the radial bearings 38, 40, and 42, is not a function of which of the two possible ways each of these bearings is installed. The direction of the circulation is not as critical as the existence of circulation past the surface 28 of shaft 10, which is where the principal cooling effect is achieved.

Referring again to FIG. 1, the operation of the radial bearings will be more readily understood. The rotation of the shaft 10 looking down toward lower end 18 from upper end 14 is clockwise, or to the right, as indicated by arrow 60. Since the orientation of the internal grooves 56 and 58 inside radial bearing 38 are also spiraling downwardly and in a clockwise manner when viewed in the same direction, the rotation of the shaft 10 urges the lubricant 31 between surface 28 and inner surface 54 of radial bearing 38 downwardly, along internal grooves such as 56 and 58, as indicated by arrow 62. This pumping action provided by rotation of shaft 10 pulls the lubricant 31 away from seal 24, which in turn induces the lubricant 31 to take its place by moving up the outer grooves, such as 46 and 48, as indicated by solid arrows 64. Some cooling of the lubricant 31 with returning mud in the annulus occurs when it flows through grooves 46 and 48. Thus, the induced circulation due to the construction of radial bearing 38, when in the uppermost position adjacent upper seal 24, is to force the lubricant 31 downwardly along shaft 10 toward lower end 18, and induce return flow on the outside of radial bearing 38 in grooves 46 and 48. This circulating action improves the cooling of the lubricant 31, as illustrated in FIGS. 5 and 6.

Figure 5:
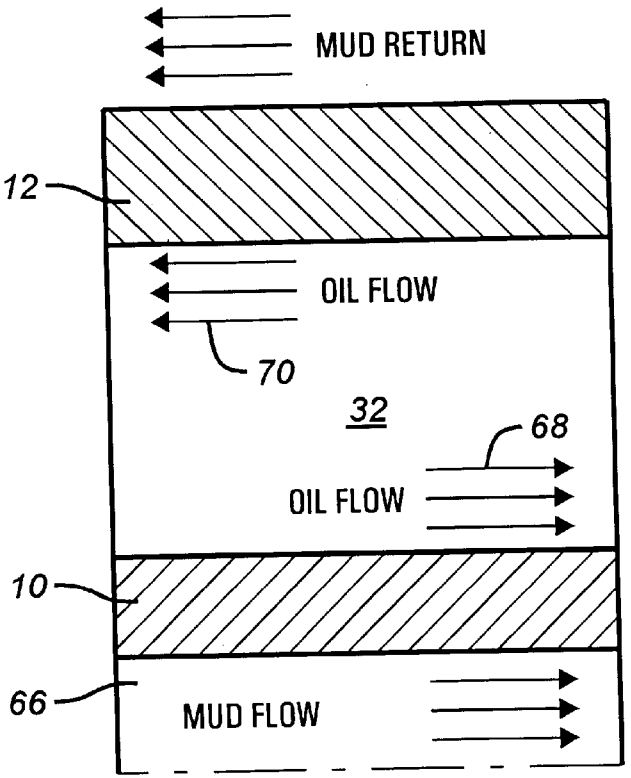

Referring to FIG. 5, a half-section illustrating the various elements previously discussed is shown. The hollow shaft 10 has a central passageway 66, through which mud flows downwardly toward the drillbit as indicated in the mud flow direction arrows shown in FIG. 5. The cavity 32 is formed between the hollow shaft 10 and the housing 12. Returning mud from the drillbit flows uphole in the annular space outside of housing 12, as indicated by a mud return arrow on FIG. 5. Arrows 68 and 70 illustrate schematically the oil flow internal the cavity 32. Arrows 68 illustrate the internal oil flow along grooves 56 and 58. Arrows 70 illustrate the external oil flow along grooves 46 and 48. It is clear that the flow indicated by arrows 68 induced by rotation of shaft 10 in the direction of arrow 60 forces the lubricant 31 downwardly toward lower end 18 adjacent to surface 28 of hollow shaft 10, thus facilitating the effective cooling due to the increased velocity of the lubricant 31 which is in contact with surface 28 of shaft 10. On the return trip back toward seal 24, along outer grooves 46 and 48, as depicted by arrow 70 in FIG. 5, some further cooling is achieved due to the mud return flow indicated in FIG. 5. However, the principal cooling takes place at the outer surface 28 of rotating shaft 10. Induced velocity of the lubricant 31 aids the heat transfer from the lubricant 31 to the mud flow illustrated in FIG. 5.

Figure 6:
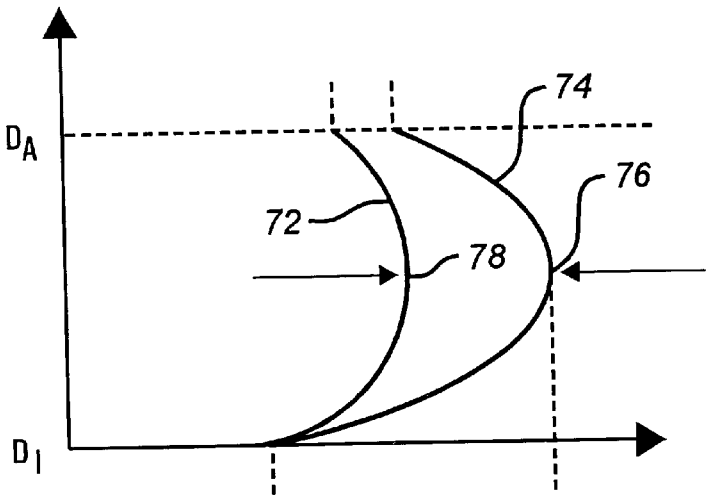
FIGS. 5 and 6 are related schematic representations showing the fluid flows and the resulting difference in overall lubricant temperature, comparing a situation of no lubricant circulation with another situation involving axial lubricant circulation.

FIG. 6 shows schematically the profile of the lubricant temperature, with curve 72 illustrating a typical radial temperature profile using the radial bearings as configured in FIGS. 2–4, while curve 74 illustrates the radial profile of temperature of lubricant with the typical bushing-type radial bearings as used in the past. The profile of FIG. 6 is taken in cavity 32 between bearings 38 and 42. As seen in FIG. 6, the peak temperature 76 is significantly higher than the peak temperature 78 when using the radial bearings of the design shown in FIGS. 2–4. The temperature trails off at either extreme for both curves due to the cooling effects of the circulating mud. FIG. 6 is intended to schematically illustrate that the lubricant 31 achieves a more uniform temperature with a reduced temperature peak. Significantly, due to the circulation effect, movement of the lubricant 31 prevents localized overheating and/or boiling of the lubricant 31, which can result in failure of seals or bearings.

The circulation through the central bearing 42 is a continuation of that previously described from upper bearing 38. The rotation of shaft 10 in the direction of arrow 60 sucks the lubricant 31 down the internal grooves, such as 56 and 58 of the radial bearing 42. The oil is further forced through the thrust bearings 36, then 34, and finally down through the lower radial bearing 40, all through the small space between surface 28 of shaft 10 and the inside surface 54 of the radial bearings 42 and 40. Eventually, the lubricant 31 is forced out adjacent seal 30 where it acts to cool the localized area where heat is generated to a greater extent in the assembly. The movement of lubricant 31 down the internal spirals 56 and 58 creates a circulation loop which forces lubricant 31 already adjacent the seal 30 back upwardly toward the upper end 14 through the exterior grooves 46 and 48 of bearing 40, past thrust bearings 34, then 36, and then past the central radial bearing 42 and back to the zone between radial bearings 38 and 42.

Those skilled in the art can now appreciate that what has been described is a simple and effective technique for circulating the lubricant 31 in a sealed cavity such as 32. The application to a downhole bearing section for a bit driven by a downhole motor is but one of many possible applications for the disclosed design. Since space is at a premium, the incorporation of grooves into the radial bearings, such as 38, creates the necessary circulating effect without the need for auxiliary pumps or cooling equipment. By taking advantage of the relatively cool mud being circulated through the hollow shaft 10 and then returned in the annular space outside of housing 12, significant amounts of heat can be transferred out of the lubricant 31, due particularly to the intimate contact with the surface 28, coupled with the induced velocity, by flow through the narrow grooves such as 56 and 58. The profile of each of the grooves, such as 46, 48, 56 and 58, can vary without departing from the spirit of the invention, and the cross-sectional area of the grooves can also be altered to affect the circulating rate of the lubricant 31 and, hence, its velocity through the radial bearing, such as 38. The inner grooves 56 and 58 are preferably laid out in a spiral design with the spiral following the direction of the rotation of shaft 10. The outer grooves 46 and 48 can be laid out in a spiral design or as straight grooves in a different path without departing from the spirit of the invention. Grooves are but one way to create the flowpath for the lubricant 31.

While spirally wound grooves internally and externally to a radial bearing have been disclosed as the preferred embodiment to attain the circulation and heat transfer desired in the cavity 32, those skilled in the art will appreciate that the scope of the invention is substantially broader so as to encompass other techniques for inducing internal circulation in a sealed lubricant reservoir to enhance the heat transfer from the lubricant 31 to the surrounding circulating fluid. Thus, it is also within the purview of the invention to create the circulation by other techniques which do not involve external auxiliary equipment, such as by taking advantage of any relative movements of the shaft 10 with respect to the housing 12 during normal operation of the bit. Those skilled in the art will appreciate that even minimal axial movements of the shaft 10 can be successfully employed to initiate the lubricant circulation which would be necessary to achieve a more uniform lubricant temperature by heat dissipation to the surrounding flowing fluids.

The based seals will be directly flushed with circulating lubricant having a uniform temperature, which prevents a stationary heat build-up directly at the seal due to effective heat transfer improved by the circulation. Abrasive particles generated from mechanical wear in the bearings are consistently moved inside the sealed bearing section. Therefore, these particles cannot bridge and build up at the seals which will prevent enhanced mechanical wear of the seals. Natural gas can diffuse inside the sealed bearing section during drilling operations. During vertical drilling, gravity will place the gas close to the upper seal. The seal will be isolated on one side by gas, which is an excellent thermal insulator and, therefore, can cause the seal to quickly bum and fail. Consistently circulating lubricant disperses the natural gas in the lubricant and, therefore, prevents a build-up of a natural gas cushion on the upper seal.

The foregoing disclosure and description of the invention are illustrative and explanatory thereof, and various changes in the size, shape and materials, as well as in the details of the illustrated construction, may be made without departing from the spirit of the invention.

What is claimed is:

1. A lubricant cooling system for a downhole sealed-bearing cavity surrounding a rotating shaft, comprising:

a housing;

a shaft extending through said housing defining a lubricant cavity therebetween;

a plurality of seals which retain lubricant in said cavity;

a circulation device disposed entirely in said cavity for circulation of said lubricant therein.

2. The system of claim 1, further comprising:

a first bearing, having a top and bottom, in said cavity, said circulation device operatively connected to said first bearing.

3. The system of claim 2, wherein:

said first bearing comprises an inner and an outer surface and at least one flowpath extending the length of at least one of said surfaces and acting as said circulation device.

4. The system of claim 3, wherein:

said flowpath extends on said inner and outer surfaces from said top of said first bearing to said bottom of said first bearing.

5. The system of claim 4, wherein:

said flowpath comprises at least one groove.

6. The system of claim 5, wherein:

said flowpath comprises at least one groove on the inner surface offset on at least one end from at least one other groove on said outer surface.

7. The system of claim 5, further comprising:

a second bearing having an inner and outer surface and at least one groove on said surfaces;

said grooves on said first and second bearings each being spirally wound and parallel as between inner and outer surfaces on each of said bearings.

8. The system of claim 5, wherein:

said flowpath comprises a plurality of grooves on said inner and outer surfaces of said first bearing.

9. The system of claim 8, wherein:

said grooves are spirally wound on said inner and outer surfaces.

10. The system of claim 9, wherein:

said grooves on said outer face are parallel to each other and said grooves on said inner face are parallel to each other; and said grooves on said outer face are offset from said grooves on said inner face at said top and bottom of said first bearing.

11. The system of claim 9, wherein:

said grooves are wound parallel on said inner and outer surfaces.

12. The system of claim 9, wherein:

grooves on said inner surface are spirally wound with the spiral following the direction of the rotation of the shaft.

13. The system of claim 1, wherein:

the movement of said shaft, in conjunction with said circulation device, circulates said lubricant in said cavity.

14. The system of claim 1, wherein:

said circulation device moving said lubricant past said seals in an axial loop in which said lubricant is forced to flow adjacent said shaft in said cavity.

15. A lubricant cooling system for a downhole sealed-bearing cavity surrounding a rotating shaft, comprising:

a housing;

a shaft extending through said housing defining a lubricant cavity therebetween;

a plurality of seals which retain lubricant in said cavity;

a circulation device in said cavity for circulation of said lubricant therein;

a plurality of bearings, each having a top and bottom, in said cavity, said circulation device operatively connected to said bearings;

at least one thrust bearing in said cavity; and at least one of said bearings circulating said lubricant through said thrust bearing.

16. A lubricant cooling system for a downhole sealed-bearing cavity surrounding a rotating shaft comprising:

a housing;

a shaft extending through said housing defining a lubricant cavity therebetween;

a plurality of seals which retain lubricant in said cavity;

a circulation device in said cavity for circulation of said lubricant therein;

said circulation device moving said lubricant past said seals in an axial loop in which said lubricant is forced to flow adjacent said shaft in said cavity;

said shaft is hollow to accommodate flow of a fluid therethrough which receives heat from said circulating lubricant; and said circulating lubricant prevents, by dispersal, the build-up of gas pockets around at least one of said seals, which would have otherwise isolated such seal from lubricant.

17. A lubricant cooling system for a downhole sealed-bearing cavity surrounding a rotating shaft, comprising:

a housing;

a shaft extending through said housing defining a lubricant cavity therebetween;

a plurality of seals which retain lubricant in said cavity;

a circulation device in said cavity for circulation of said lubricant therein;

said shaft is hollow to accommodate flow of a fluid therethrough which receives heat from said circulating lubricant.

18. A cooling system for a sealed-bearing cavity around a rotating shaft, comprising:

a housing having an interior wall;

a shaft extending through said housing defining a cavity;

a bearing in said cavity;

a plurality of seals, said seals holding lubricant in said cavity;

said bearing formed having a circulation passage thereon;

said shaft moves in said housing and said shaft movement is the exclusive force creating axial circulation of said lubricant along said shaft or interior wall of said housing.

19. The system of claim 18, wherein:

said passage comprises at least one groove on an inside face of said bearing adjacent said shaft and on an outside face adjacent said inner wall of said housing, said grooves are spirally wound and parallel such that rotation of said shaft induces circulation of said lubricant around said bearing.

20. A cooling system for a bearing section around a hollow shaft connected to a drillbit and driven from a downhole motor by drilling mud flowing through said motor shaft and bit, comprising:

a hollow shaft extending through a housing defining a lubricant cavity;

a plurality of seals to hold lubricant in said cavity;

at least one bearing in said cavity having an inner face adjacent said shaft and an outer face adjacent an inner wall of said housing;

said faces comprising a flowpath whereupon movement of said shaft, said lubricant is forced to circulate through said flowpath for cooling thereof with drilling mud flowing in said shaft.

21. The system of claim 20, further comprising:

a plurality of said bearings, each having a plurality of grooves spirally wound on both said inner and outer faces, with said windings being parallel as between said inner and outer faces thereof which form an axial flowpath.

* * * * *